US005964461A

United States Patent [19]

Ende et al.

[11] Patent Number: 5,964,461

[45] Date of Patent: Oct. 12, 1999

[54] PUSHER BLOCK ASSEMBLY FOR PRINTING PRESS

[75] Inventors: Don Ende, Commack; Mario Lisena, Glen Cove, both of N.Y.

[73] Assignee: Halm Industries Co., Inc., Glen Head, N.Y.

[21] Appl. No.: 08/943,365

[22] Filed: Oct. 3, 1997

[51] Int. Cl.[6] ..... B65H 5/16

[52] U.S. Cl. ..... 271/271; 271/198; 198/732

[58] Field of Search ..... 271/271, 275, 271/198; 198/732, 718

[56] References Cited

U.S. PATENT DOCUMENTS

| | | | |
|---|---|---|---|
| 1,971,875 | 8/1934 | Pert | 198/732 |
| 2,780,342 | 2/1957 | Good | 198/732 |
| 2,861,677 | 11/1958 | Marle | 198/732 |
| 4,004,680 | 1/1977 | Warmann | 198/732 |
| 4,417,653 | 11/1983 | Zwezerynen | 198/732 |
| 4,505,093 | 3/1985 | Johnson | 198/732 X |
| 4,588,184 | 5/1986 | Jeschke . | |
| 4,717,142 | 1/1988 | Saito et al. . | |
| 4,986,522 | 1/1991 | Paulson . | |
| 5,028,045 | 7/1991 | Muller | 271/271 |
| 5,165,523 | 11/1992 | Wooley et al. . | |

FOREIGN PATENT DOCUMENTS

| | | | |
|---|---|---|---|
| 297618 | 1/1992 | Germany | 198/732 |
| 542693 | 1/1977 | Russian Federation | 198/732 |

*Primary Examiner*—William E. Terrell
*Assistant Examiner*—Patrick Mackey
*Attorney, Agent, or Firm*—Hoffman & Baron, LLP

[57] ABSTRACT

A pusher block assembly is provided for use in the aligner section of a printing press. The assembly includes a pusher which automatically tilts rearwardly and translates downwardly at the discharge end of the aligner section, thereby preventing damage to the trailing edges of the articles transferred to the printing section of the press. The pushers are also pivotable between upright and horizontal positions. This feature eliminates the need for removal of the pusher block assembly when relatively long articles are conveyed by the aligner section.

23 Claims, 4 Drawing Sheets

PUSHER BLOCK ASSEMBLY FOR PRINTING PRESS

BACKGROUND OF THE INVENTION

1. Field of the Invention

The field of the invention relates to assemblies for feeding envelopes or sheets to the printing drums or rollers of a printing press, and particularly to pusher block assemblies for urging the envelopes or sheets towards the drums or rollers.

2. Brief Description of the Prior Art

Assemblies referred to as aligners are employed in printing presses for feeding envelopes and other sheet-like items to printing stations. Aligners are often comprised of a pair of parallel, endless chains to which pusher block assemblies are affixed. The pusher block assemblies include rod-like elements known as pushers. The pushers engage the rear edges of the envelopes, ensuring that the envelopes are fed to the print rollers in proper orientations for printing. U.S. Pat. Nos. 4,588,184 and 4,717,142 disclose aligners known to the art.

A printing press is ordinarily used to print many different sizes of items. In order to print relatively long items exceeding the spacing along the chain between successive pushers, it may be necessary to remove a number of pusher block assemblies from the aligner chains in order to prevent them from contacting the bottom surfaces of the items. Such contact can result in misalignment and/or jams as the items are fed to the printing rolls. The pusher block assemblies are reattached to the aligner chains when shorter items are to be printed in order to maximize the efficiency of the press. The removal and reattachment of pusher block assemblies can be a time-consuming process, requiring precise alignment and resulting in delays before the press can again be used in an efficient and effective manner. U.S. Pat. No. 5,165,523 discloses the removal of pusher block assemblies for accommodating large size envelopes.

In feeding items such as envelopes to the print rollers, it is also important to avoid damaging the trailing edges of the items, which are engaged by the pushers until they exit the aligner section of the printing press. Such exiting occurs as the chains move about a sprocket, thereby causing the pushers to travel about an arc. If the pushers cause a downward force to be exerted upon the trailing edges of the items as they exit the aligner section, these edges can become creased or otherwise damaged. U.S. Pat. No. 4,986,522 discloses a pusher block assembly including means for preventing envelopes from being hung up by the pushers.

SUMMARY OF THE INVENTION

It is an object of the invention to provide an assembly for feeding envelopes of various sizes to the printing section of a printing press without the need for removing pusher block assemblies from the aligner chains to which they are attached.

It is another object of the invention to provide a pusher block assembly for the aligner section of a printing press which avoids marking or damaging the rear edge of an envelope as it is fed to the printing section of the press.

In accordance with one or more objects of the invention, a pusher block and chain assembly is provided which includes an aligner chain, a pusher mounting block secured to the aligner chain and substantially coplanar therewith, and a pusher movably coupled to the pusher mounting block, the pusher being movable between a first position wherein said pusher extends substantially vertically with respect to a plane extending through the pusher block and aligner chain, and is capable of engaging a trailing edge of an envelope, and a second position wherein the pusher is substantially horizontal to said plane. An envelope can overlie a pusher in the second position without being vertically displaced. Removal of such a pusher block assembly from the chain is accordingly unnecessary should it be necessary to feed relatively long envelopes to the printing section of a printing press.

In accordance with a preferred embodiment of the invention, a pusher adjustment block is slidably mounted to the pusher mounting block, and the pusher is coupled to the pusher adjustment block. A pusher block may be pivotably mounted to the pusher adjustment block, while the pusher is pivotably mounted to the pusher block.

In accordance with another embodiment of the invention, a pusher block assembly is provided which includes a pusher mounting block, a pusher block coupled to the pusher mounting block and pivotable with respect to the pusher mounting block about a pivot axis, the pusher block including an engagement or camming surface extending beneath the pusher mounting block such that pressure exerted upon the engagement surface causes the pusher block to rotate about the pivot axis, and a pusher coupled to the pusher block. This construction allows the pusher to translate in a downward direction and to be tilted rearwardly as it disengages from a guide located near the discharge end of the aligner section of the printing press. It accordingly cannot exert a downward force on the trailing edge of an envelope as the envelope is fed to a printing section of a printing press.

An assembly for feeding envelopes or sheets is also provided by the invention. This assembly includes first and second substantially parallel aligner chains, and a plurality of pusher block assemblies mounted to each of the chains. Each pusher block assembly includes a pusher movable, and preferably pivotable, between a first position wherein the pusher is substantially vertical to a plane including the first and second aligner chains, and a second position substantially parallel to said plane. The individual pusher adjustment blocks can be adjusted forward or backward along the axis of travel of each chain.

DETAILED DESCRIPTION OF THE INVENTION

Figure 1:
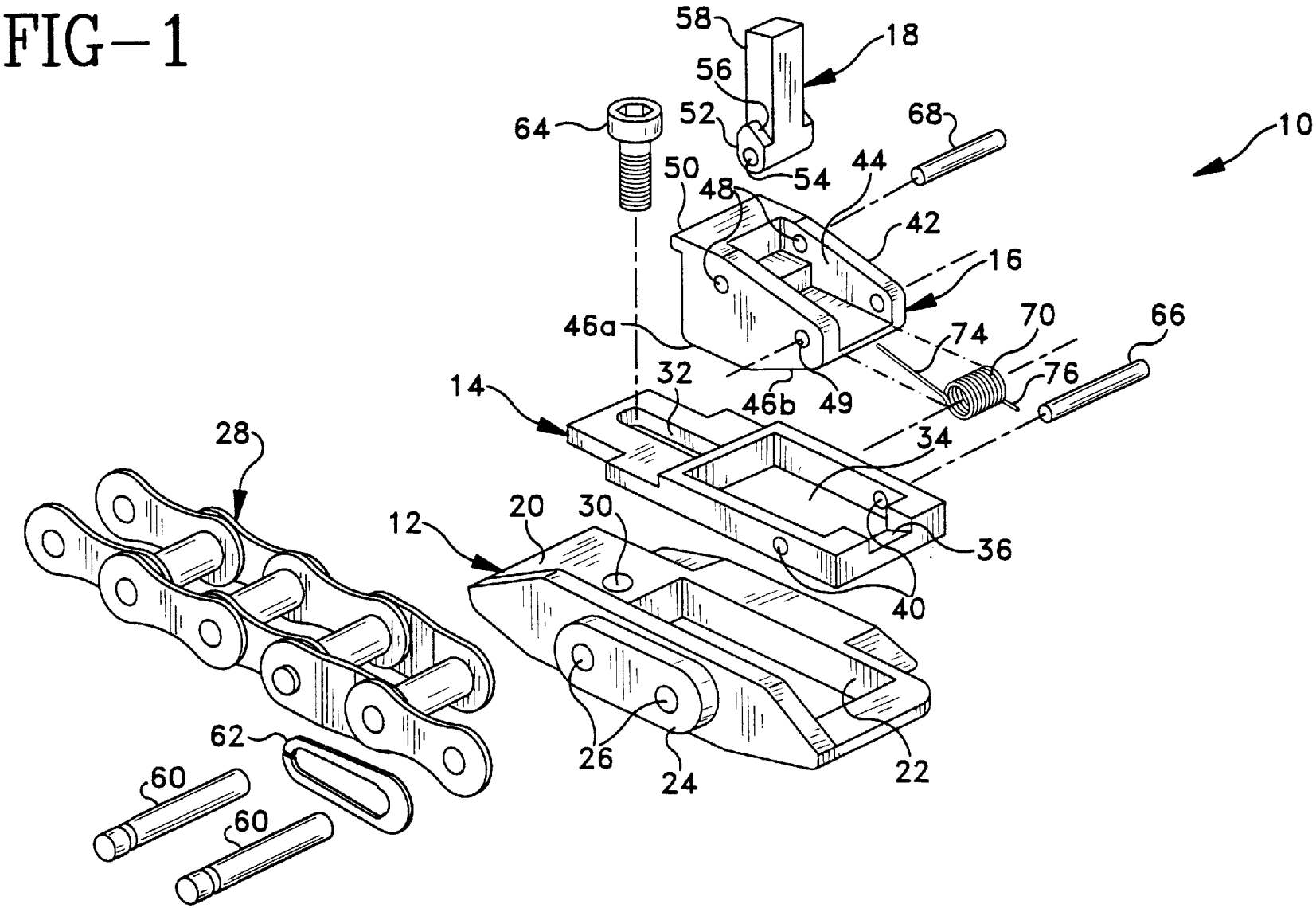
FIG. 1 is an exploded perspective view of a pusher block assembly according to the invention, and associated aligner chain.
Figure 2:
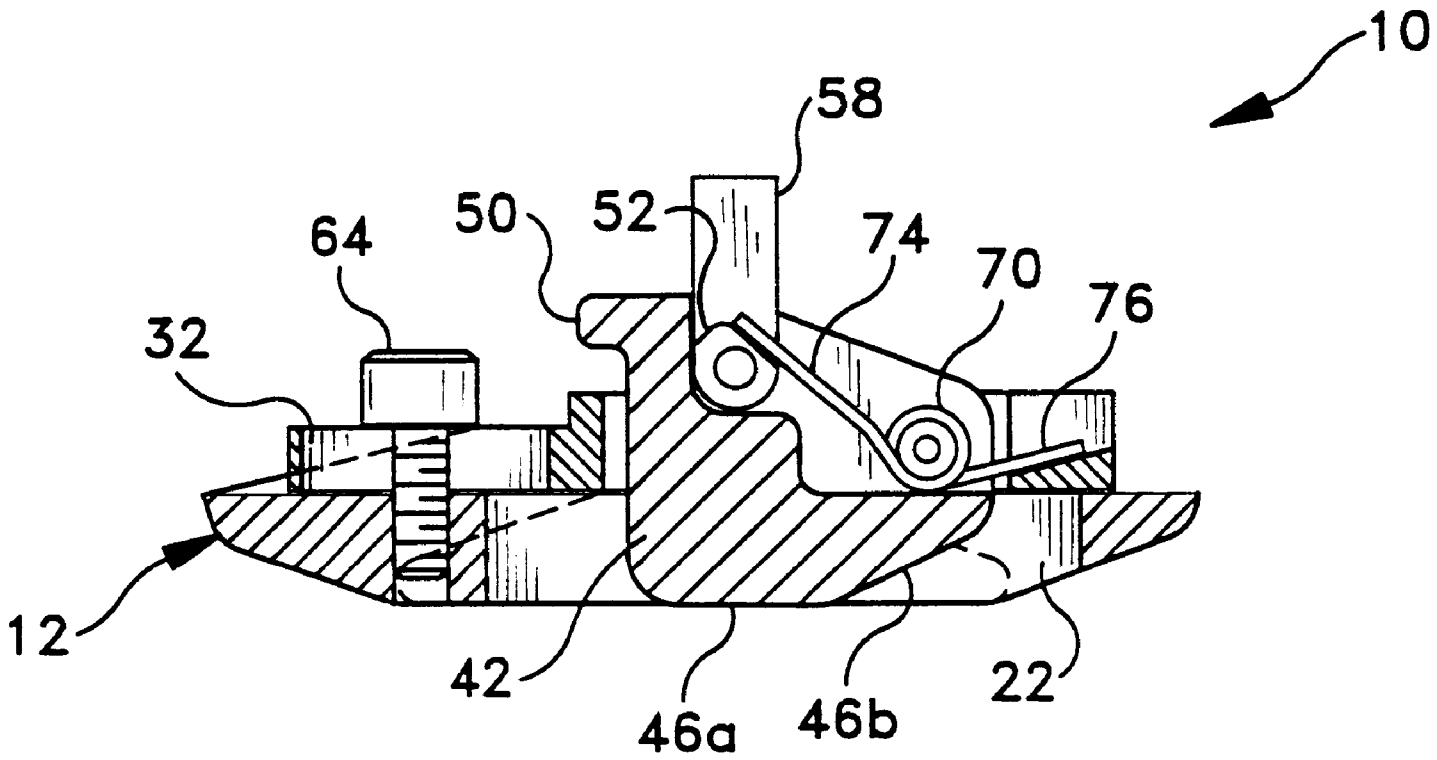
FIG. 2 is a sectional view of the pusher block assembly.

A pusher block assembly 10 for use in the aligner section of a printing press is provided by the invention. A preferred embodiment thereof is shown in the drawings and described below.

As shown in FIG. 1, the pusher block assembly 10 according to the preferred embodiment is comprised of four basic components: a pusher mounting block 12, a pusher adjustment block 14, a pusher block 16 and a pusher 18. The pusher mounting block includes a generally flat, rectangular body 20. The bottom surface thereof is inclined upwardly at the front and rear ends. A rectangular opening 22 extends through the center portion of the body, as shown in FIG. 1. One of the side walls of the body 20 includes a generally oval protrusion 24. A pair of cylindrical passages 26 extend through this side wall and protrusion, thereby allowing the pusher block assembly to be secured to an aligner chain 28. A threaded hole 30 extends through the body of the pusher mounting block, and includes an opening at the upper surface thereof.

The pusher adjustment block 14 includes a flat, generally rectangular body which is shorter in length and width than the pusher mounting block 12. A slotted opening 32 extends through the rear portion of the pusher mounting block. A relatively large, rectangular opening 34 extends through the front portion thereof. This rectangular opening 34 is shorter in length than that extending through the pusher mounting block. A notch 36 is formed in the end wall of the pusher adjustment block. A pair of opposing passages 40 are provided in the side walls of the pusher adjustment block. These openings are located at opposite sides of the rectangular opening 34.

The pusher block 16 is comprised of a generally wedge-shaped body 42 including a rectangular notch 44 in the upper portion thereof. The width of the body 42 is slightly less than the width of the rectangular openings in the pusher adjustment block and pusher mounting block. The bottom surface of the body 42 is comprised of two planar surfaces 46*a*, 46*b* which adjoin at a rounded edge. The bottom surface functions as a camming surface which engages a guide, thereby maintaining the pusher block in a selected orientation. A pair of coaxial passages 48 are provided in the side walls of the pusher block which border the notch 44. Finally, the pusher block includes a rearwardly extending projection 50 which functions as a stop in the manner described below.

The pusher 18 includes a base 52 having a width which is slightly smaller than the width of the notch 44 in the pusher block. A cylindrical passage 54 extends through the base. The bottom surface of the base is round. The top surface thereof includes inclined planar surfaces 56. A rectangular projection 58 extends from the top surface of the base 52. The length of the projection considerably exceeds the maximum depth of the notch 44 in the pusher block. The thickness of the projection is no greater than the maximum depth of this notch. At least the front surface of the projection is planar and smooth.

Figure 3:
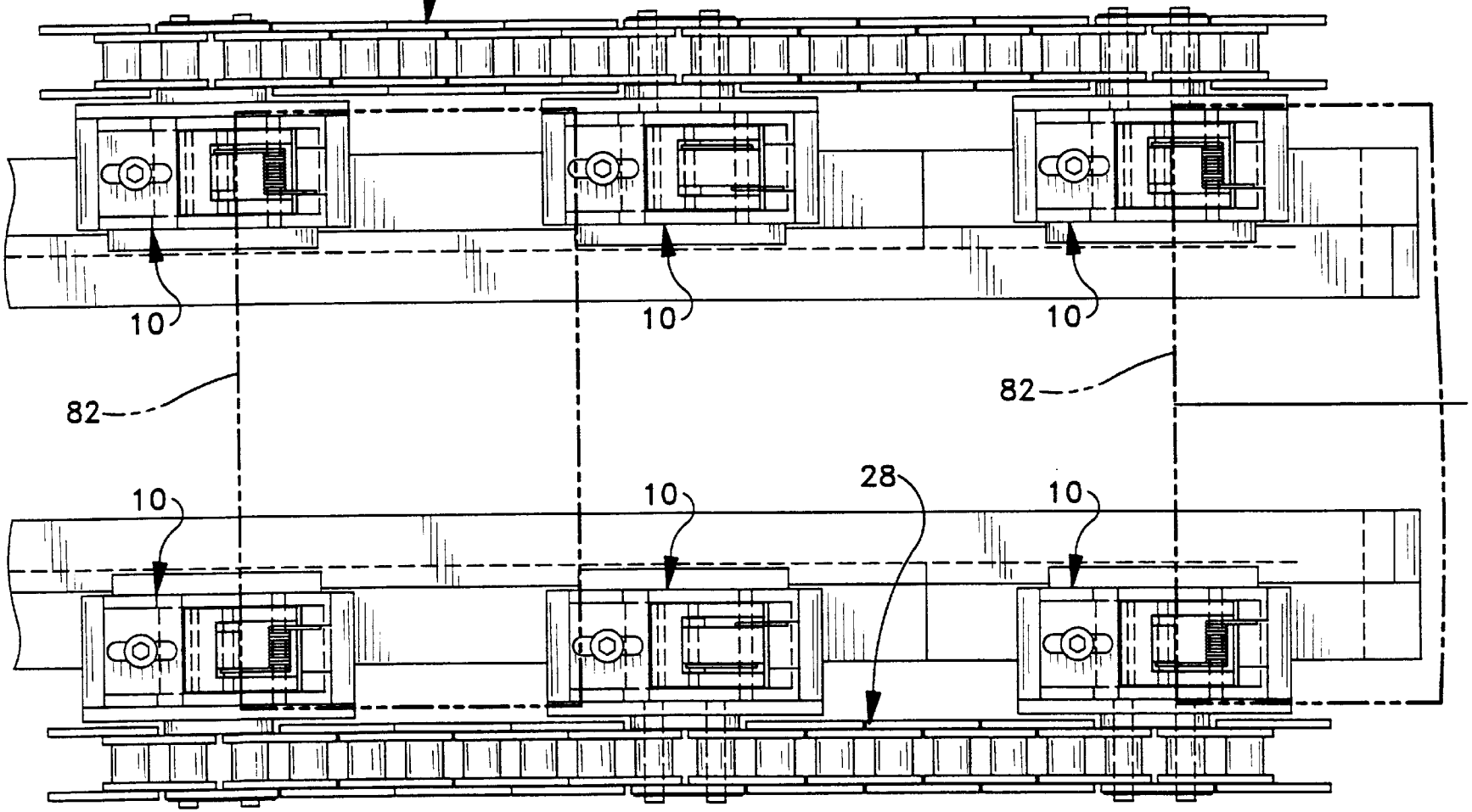
FIG. 3 is a top plan view of an aligner section of a printing press, including pusher block assemblies according to the invention.
Figure 4:
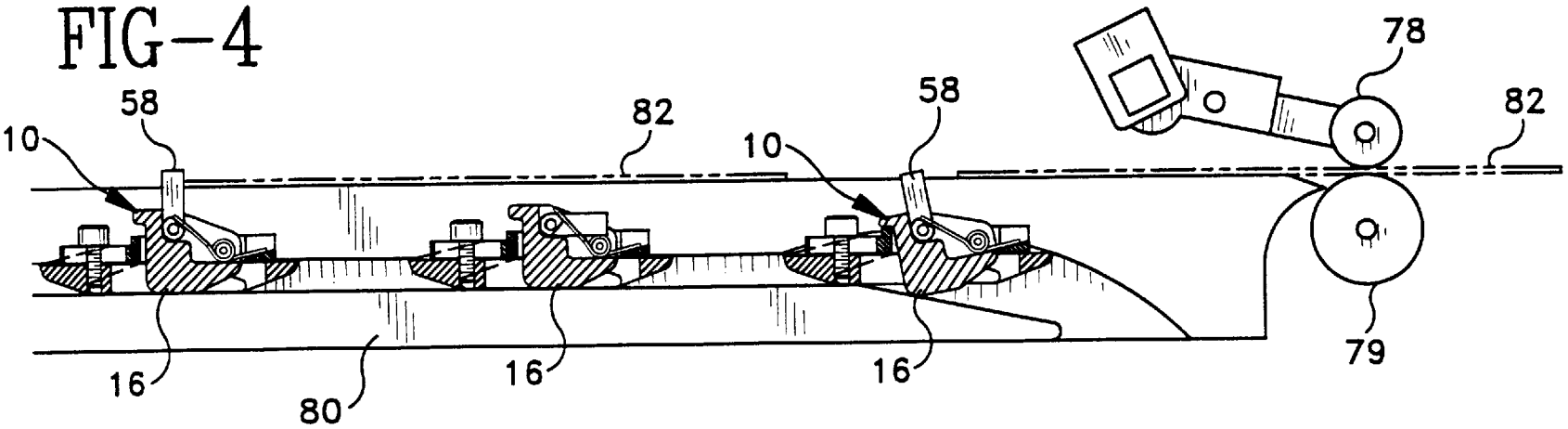
FIG. 4 is a partially sectional view of the aligner section which schematically illustrates the transfer of articles to the printing section of a printing press.

The pusher mounting block 12 is mounted to an aligner chain by a pair of pins 60 extending through one of the links of the chain and into the passages 26 in the side wall of the mounting block. The pins may be press fit or otherwise secured within these passages. A clip 62 engages annular grooves formed within the pins, thereby preventing the mounting block and chain from uncoupling. As shown in FIGS. 3 and 4, a plurality of pusher block assemblies are mounted to the aligner chains of a printing press.

The adjustment block 14 is slidably mounted to the mounting block 12 such that the rectangular openings 34,22 thereof are in registration. The elongate slot 32 of the adjustment block is also in registration with the threaded hole 30 in the mounting block, which allows the translational position of the adjustment block to be fixed by a threaded cap screw 64. The vertical passage includes threads (not shown) which mate with those of the cap screw. One side of the adjustment block abuts one of the side walls of the mounting block, thereby maintaining the alignment of the adjustment block as it is moved with respect to the mounting block.

The pusher block 16 is pivotably secured to the adjustment block by a pin 66 extending through the coaxial passages 40 in the side walls of the adjustment block and a cylindrical passage 49 near the front end of the pusher block. The bottom surface of the pusher block is capable of extending beneath the bottom surface of the pusher mounting block 12 when in certain rotational positions. Rotation beyond a selected point is prevented by engagement of the projection 50 with the upper surface of the pusher alignment block 14.

The pusher 18 is pivotably secured to the pusher block by a pin 68 extending through the base of the pusher as well as the coaxial passages 48 near the rear end of the notch 44 in the pusher block. The pusher is located near the vertical wall defining the rear end of the notch such that, when pusher is in the upright position, its rear vertical surface engages the rear end of the notch creating a back-stop.

A spring 70 is secured to the front end of the pusher adjustment block by the pin 66. The pin extends through the coiled portion of the spring and the coaxial passages 40 in the walls of the pusher adjustment block. The spring includes a pair of projections 74, 76, one of which bears against the bottom surface of the notch 36, the other of which bears against the upper surface 56 of the base of the pusher. The spring thereby resiliently urges the pusher block about the pin 66 which connects it to the pusher adjustment block. The spring also retains the pusher vertically against the rear end of the notch in the pusher block or in its downward position within the notch, as required.

Figure 4A:
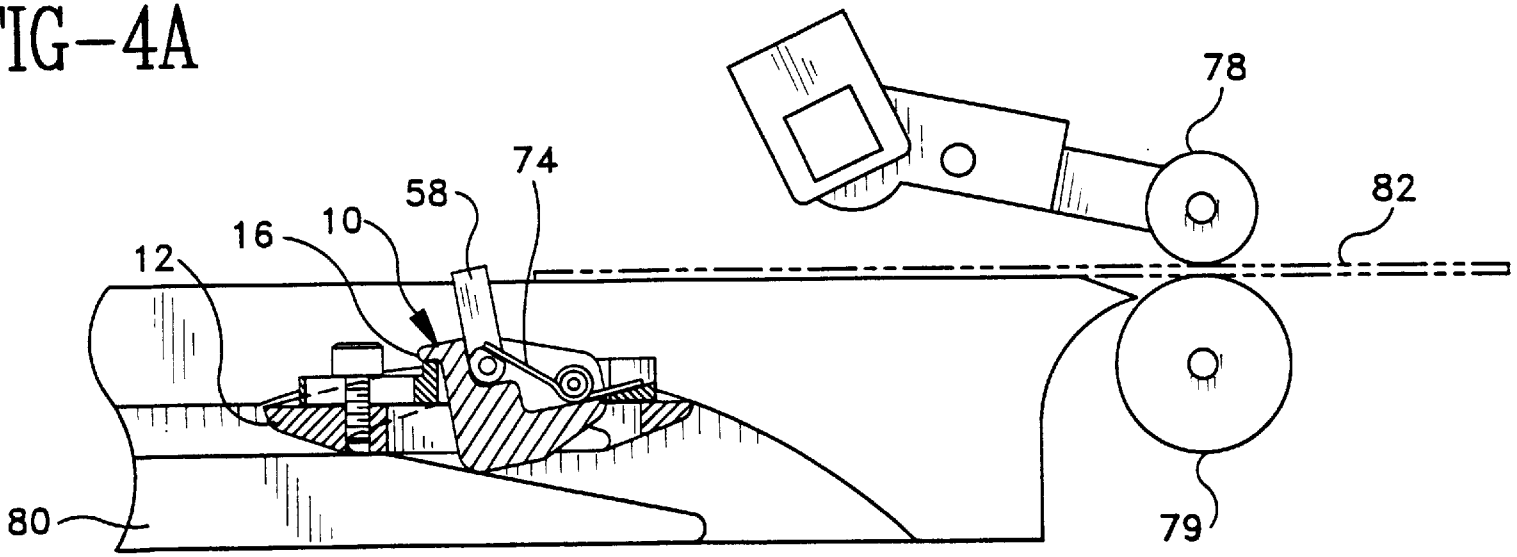
FIG. 4A is an enlarged view of the discharge end of part of the aligner section.

FIGS. 3,4 and 4A show the pusher block assembly 10 as employed in the aligner section of a printing press. The aligner section includes a pair of parallel, coplanar chains 28 which are driven by sprockets (not shown). The pusher block assemblies are mounted to the chains such that the pushers 18 are in opposing relation to each other. Precise positioning of the pushers can be accomplished by loosening the cap screws 64 and moving the pusher adjustment blocks 14 to the desired positions. The screws are then tightened to maintain the pushers and pusher adjustment blocks in the selected translational positions. The front surfaces of the pushers 18 are used to engage and maintain the alignment of flat articles such as envelopes as they are transported and then fed to the spring-loaded pinch roller 78 and entrance roller 79 in the printing section of the press. As shown in FIGS. 3 and 4, the pusher block assemblies 10 are positioned over elongate guides 80. The bottom surfaces of the pusher blocks 16 engage the upper surfaces of the guides, thereby urging the pusher blocks and associated pushers upwardly with respect to the pusher mounting blocks throughout most of their travel towards the printing section. The projections 50 of the respective pusher blocks are accordingly spaced above the upper surfaces of the pusher alignment blocks, while the pushers 18 are in substantially upright if in raised positions. The front surfaces of the pushers will accordingly be substantially vertically oriented as they engage the trailing surfaces of the articles conveyed to the printing rolls. When the pusher block assemblies approach the entrance roller end of the aligner section, as best shown in FIG. 4A, the pusher blocks rotate under the forces of the springs 70 until the projections 50 engage the upper surfaces of the pusher alignment blocks 14. Such rotation occurs as the guides are tapered near the entrance roller end of the aligner section, and allow increased pusher block rotation as the pusher block assemblies approach the ends of the guides. The pushers 18 are accordingly rotated about the pivot axes of the pusher blocks 16 as the articles 82 exit the aligner section. Being rearwardly inclined and translating vertically, at this point, the pushers are then incapable of exerting any forces on the trailing edges of the articles. These edges will accordingly emerge from the press without damage or creasing.

As shown in FIG. 4, the aligner section may be employed to feed many sizes of articles without the need for removing pusher block assemblies. Instead of removing selected assemblies, the pushers are simply rotated forwardly into horizontal positions. The articles can thereby overlie the horizontally inclined pushers while being maintained in horizontal positions themselves. If relatively short articles are to be printed thereafter, some or all of the pushers can be flipped up to vertical positions, where they will engage the trailing edges of the articles.

It will be appreciated that modifications can be made to the assembly described above without departing from the spirit of the invention.

What is claimed is:

1. A pusher block and chain assembly for a printing press, comprising:

an aligner chain;

a pusher mounting block secured to said aligner chain and substantially coplanar therewith;

a pusher block coupled to said pusher mounting block and pivotable with respect to said pusher mounting block; and a pusher movably coupled to said pusher block and being pivotably mounted to said pusher block, said pusher being movable between a first position wherein said pusher extends substantially vertically with respect to a plane extending through said pusher block and aligner chain, and is capable of engaging a trailing edge of an envelope, and a second position wherein said pusher is substantially horizontal to said plane.

2. An assembly as described in claim 1 including a pusher adjustment block slidably mounted to said pusher mounting block, said pusher being coupled to said pusher adjustment block and slidable therewith relative to said pusher mounting block.

3. An assembly as describes in claim 2 including means for securing said pusher adjustment block in a fixed position on said pusher mounting block.

4. An assembly as described in claim 1 wherein said pusher block includes a camming surface extending beneath said pusher mounting block.

5. An assembly as described in claim 4 including a pusher adjustment block slidably mounted to said pusher mounting block, said pusher block being pivotably mounted to said pusher adjustment block.

6. An assembly as described in claim 5 including means for resiliently urging said pusher block about a pivot axis towards a first position.

7. An assembly as described in claim 6 including a guide bearing against said camming surface of said pusher block.

8. A pusher block assembly for a printing press, comprising:

a pusher mounting block;

a pusher block coupled to said pusher mounting block and pivotable with respect to said pusher mounting block about a pivot axis, said pusher block including a camming surface extending beneath said pusher mounting block such that pressure exerted upon said engagement surface causes said pusher block to rotate about said pivot axis; and a pusher pivotably coupled to said pusher block.

9. A pusher block assembly as described in claim 8 including a guide bearing against said camming surface of said pusher block.

10. A pusher block assembly as described in claim 9 wherein said guide includes a horizontal surface and a downwardly tapered end surface adjoining said horizontal surface.

11. A pusher block assembly as described in claim 8 including a pusher adjustment block slidably mounted to said pusher mounting block, said pusher block being pivotably mounted to said pusher adjustment block.

12. A pusher block assembly as described in claim 11 including means for securing said pusher adjustment block in a fixed position on said pusher mounting block.

13. A pusher block assembly as described in claim 8 including means for resiliently urging said pusher block about said pivot axis towards a first position.

14. A pusher block assembly as described in claim 13 including a stop engageable with said pusher block, thereby preventing said means for resiliently urging from moving said pusher block beyond said first position.

15. An assembly for feeding envelopes or sheets, comprising:

first and second substantially parallel aligner chains; and a plurality of pusher block assemblies mounted to each of said aligner chains, each of said pusher block assemblies including;

a mounting block secured to one of said chains, a pusher block pivotably coupled to said mounting block, and a pusher pivotably mounted to said pusher block and movable between a first position wherein said pusher is substantially vertical to a plane including said first and second aligner chains, and a second position wherein said pus her is substantially parallel to said plane.

16. An assembly as described in claim 15 including a pair of guides, each of said pusher blocks including a camming surface which is engageable with one of said guides, thereby maintaining said pusher blocks in selected rotational positions.

17. An assembly as described in claim 16 wherein each of said pusher block assemblies includes an adjustment block slidably mounted to said mounting block, said pusher block being pivotably mounted to said adjustment block.

18. An assembly as described in claim 16 wherein each of said pusher block assemblies includes a spring engaging said pusher, said spring being capable of maintaining said pusher in either of said first and second positions, said spring also urging said pusher block with respect to said mounting block about a pivot axis.

19. A pusher block assembly for a printing press, comprising:

a pusher mounting block;

a pusher block coupled to said pusher mounting block and pivotable with respect to said pusher mounting block about a pivot axis, said pusher block including a camming surface extending beneath said pusher mounting block such that pressure exerted upon said engagement surf ace causes said pusher block to rotate about said pivot axis, a pusher coupled to said pusher block; and a pusher adjustment block slidably mounted to said pusher mounting block, and said pusher block being pivotably mounted to said pusher adjustment block.

20. An assembly for feeding sheet material in a printing press, comprising:

an aligner chain moveably supported within the printing press;

a first pusher block secured to said aligner chain and having a range of motion in the printing press, said first pusher block;

a first pusher pivotally mounted to said first pusher block, said first pusher being selectively positionable relative to said first pusher block between a raised position wherein said first pusher extends substantially vertically with respect to a first plane extending through said first pusher block and is engagable with an edge of the sheet material and a lowered position wherein said first pusher is substantially horizontal to said first plane and is not engagable with the edge of the sheet material, said first pusher being positionable in said raised position absent a biasing force tending to move said first pusher toward said lower position and being positionable in said lowered position absent a biasing force tending to move said first pusher toward said lower position, whereby said first pusher is maintained in said selected position through out said range of motion of said first pusher block in the printing press.

21. An assembly as described in claim 20 including a second pusher block secured to said aligner chain at a position spaced from said first pusher block, said second pusher block including a second pusher pivotally mounted to said second pusher block, said second pusher being selectively positionable relative to said second pusher block between a raised position wherein said second pusher extends substantially vertically with respect to a second plane extending through said second pusher block and is engagable with an edge of the sheet material and a lowered position wherein said second pusher is substantially horizontal to said second plane and is not engagable with the edge of the sheet material.

22. An assembly as described in claim 21 wherein said first pusher is in said raised position and said second pusher is in said lowered position.

23. An assembly as described in claim 20 further including a mounting block secured to said aligner chain, and wherein said first pusher block is pivotally coupled to said mounting block.

* * * * *